United States Patent [19]

Ban et al.

[11] Patent Number: 5,067,555

[45] Date of Patent: Nov. 26, 1991

[54] PROCESS AND APPARATUS FOR CONTINUOUS CASTING OF METAL STRIP

[75] Inventors: Takeshi Ban, Shinnanyo; Shigeru Matsunaga, Tokuyama; Hidemi Hirano, Tokuyama; Tuguo Isobe, Tokuyama; Yoshio Takakura, Hitachi, all of Japan

[73] Assignees: Nisshin Steel Co., Ltd.; Hitachi Ltd., both of Tokyo, Japan

[21] Appl. No.: 550,770

[22] Filed: Jul. 10, 1990

[30] Foreign Application Priority Data

Jul. 11, 1989 [JP] Japan ..... 1-178765

[51] Int. Cl.[5] ..... B22D 11/06

[52] U.S. Cl. ..... 164/480; 164/428; 164/437

[58] Field of Search ..... 164/480, 428, 437, 489, 164/429, 479

[56] References Cited

FOREIGN PATENT DOCUMENTS

| | | | |
|---|---|---|---|
| 2619032 | 2/1989 | France | 164/437 |
| 60-21171 | 2/1985 | Japan | 164/437 |
| 60-39461 | 6/1985 | Japan . | |
| 60-130455 | 7/1985 | Japan . | |
| 63-188454 | 4/1988 | Japan . | |
| 63-132754 | 6/1988 | Japan | 164/437 |
| 63-203254 | 8/1988 | Japan . | |
| 1-228649 | 9/1989 | Japan | 164/428 |

*Primary Examiner*—Kuang Y. Lin

*Attorney, Agent, or Firm*—Lowe, Price, LeBlanc & Becker

[57] ABSTRACT

In a twin roll continuous casting apparatus comprising a pair of internally cooled rolls rotating in the opposite direction of each other and disposed parallel to each other with their axes held horizontal, a pair of side dams for forming a pool of molten metal having a predetermined height on the circumferential surfaces of the rolls disposed in the direction perpendicular to the roll axes with a space therebetween approximately corresponding to the width of a metal strip to be cast and a pair of longitudinal dams having respective inside walls along the roll axes to form the pool of molten metal together with the side dams and the circumferential surfaces of the rolls, the improvement wherein one of the longitudinal dams is constructed so that it constitutes an intermediate tundish for pouring a substantially horizontal film flow of molten metal near the level of the surface of molten metal in the pool.

4 Claims, 3 Drawing Sheets

PROCESS AND APPARATUS FOR CONTINUOUS CASTING OF METAL STRIP

TECHNICAL FIELD OF THE INVENTION

The present invention relates to an improved process for continuously casting a metal strip directly from molten metal and to a twin roll continuous casting apparatus suitable for use in carrying out the process.

PRIOR ART

Processes for continuously casting a metal strip directly from molten metal, e.g. molten steel, are promising because of their inherent advantages including the elimination of the need for surface mending, transport and storage of a cast strand, hot rolling, the added capability of producing metal strips of hard rollable materials and enhancement of product quality due to rapid solidification by quenching. Accordingly, various proposals have been made in this art. Among others, such processes using a twin roll continuous casting apparatus are attractive in that molten metal is solidified on the surfaces of a pair of rolls under substantially the same conditions, providing a uniformly solidified product; solidified shells formed on the surfaces of the respective rolls rotating in the opposite direction of each other are combined together and rolled when they pass through the narrowest gap of the rotating rolls, resulting in a product with reduced inner porosity and good surface texture. In this art, however, since the steps of surface mending and hot rolling of the cast product are eliminated, severe requirements are imposed on the quality of the as cast product. Particularly important is the surface quality of the cast strip. It is required to completely prevent surface defects such as molten metal wrinkles, crackings and those due to entanglement of alien objects.

In order to prevent the occurrence of such surface defects, it is essential to make the molten metal in the pool formed on the circumferential surfaces of the rolls uniform in its temperature distribution and its flow. If the molten metal flow is stagnant in any areas of the surface of the molten metal in the pool, the temperature of the molten metal decreases in these areas, and solidified metal or a scum of floating oxides will be formed. The solidified metal and scum may be rolled in the solidified shells by the rotating rolls, resulting in surface defects in the cast strip. If the temperature of molten metal in the pool is not uniform in the transverse direction of the strip being cast, the surface temperature distribution of the cast strip will become non-uniform, which may cause cracking when the strip is cooled.

In a twin roll continuous casting apparatus, it is therefore particularly important how molten metal is supplied to the molten metal pool formed on the circumferential surfaces of the pair of rolls. JP B 60-39,461 and JP A 60-130,455 disclose methods for supplying molten metal to the molten metal pool wherein molten metal is poured in the pool from above in a belt-like flow. JP A 63-188,454 and JP A 63-203,254 disclose methods for supplying molten metal to the molten metal pool wherein molten metal is poured in the pool by means of special nozzles.

PROBLEMS IN THE ART AND OBJECT OF THE INVENTION

By the prior art methods wherein molten metal is poured in the pool from above in the form of belt-like flow it is difficult to pour molten metal over the total surface of the molten metal pool. Accordingly, in those areas other than those where molten metal is poured, the molten metal becomes stagnant to some extent and is likely to form a skin of solidified metal. Due to variations in the depth of molten metal in the pool and rotation of the pair of cooling rolls, the solidified skin may become entangled between solidified shells formed on the rolls immersed in the pool and rolled together with the shells, resulting in surface defects in the cast strip.

Accordingly, an object of the invention is to establish a technology for pouring molten metal in a twin roll continuous casting apparatus for producing a metal strip directly from molten metal in which the flow of molten metal is consistent over the total surface of the molten metal pool thereby creating a uniform temperature distribution of molten metal throughout the pool. A metal strip of good quality is produced which is free from surface defects due to the above-mentioned solidified skin, crackings due to non-uniform solidification and other surface defects such as porosity.

SUMMARY OF THE INVENTION

To achieve the above-mentioned object, the invention provides a process for continuously casting a metal strip by means of a twin roll continuous casting apparatus comprising a pair of internally cooled rolls rotating in the opposite direction to each other and disposed parallel to each other with their axes held horizontal. A pair of side dams for forming a pool of molten metal having a predetermined height on the circumferential surfaces of the pair of rolls are disposed in the direction perpendicular to the roll axes with a space therebetween approximately corresponding to the width of a metal strip to be cast. The process comprises continuously pouring molten metal in said pool of molten metal so that the predetermined level of the molten metal may be maintained in the pool, and continuously casting the molten metal in the pool into a metal strip through a gap between the pair of rolls while cooling the molten metal with the circumferential surfaces of the pair of rolls, characterized in that the molten metal is poured in the pool by forming a unidirectional, substantially horizontal film flow of the molten metal directing from one roll to the other roll in the vicinity of the level of the surface of molten metal in the pool.

The invention further provides a twin roll continuous casting apparatus comprising a pair of internally cooled rolls rotating in the opposite direction to each other and disposed parallel to each other with their axes held horizontal. A pair of side dams for forming a pool of molten metal having a predetermined height on the circumferential surfaces of the pair of rolls are disposed in the direction perpendicular to the roll axes with a space therebetween approximately corresponding to the width of a metal strip to be cast. Molten metal is continuously poured in the pool and through a gap between the pair of rolls while cooling the molten metal with the circumferential surfaces of the pair of rolls to for a metal strip. The apparatus is further characterized in that a pair of longitudinal dams having respective inside walls along the roll axes to form the pool of molten metal together with the pair of side dams and the circumferential surfaces of the pair of rolls are disposed in such a manner that the bottom surfaces of the longitudinal dams slidably contact the circumferential surfaces of the pair of rolls. One of the longitudinal dams is provided with an inner hollow space within the body of said longitudinal dam having a slit-like opening horizontally extending in the direction of the roll axes and communicating with said inner hollow space on its inside wall forming the pool of molten metal whereby said longitudinal dam having the inner hollow space and the slit-like opening constitutes an intermediate tundish for pouring molten metal in said pool.

It is preferred that the inside wall of the other longitudinal dam forming the pool of molten metal has a curved surface outwardly expanding downward whereby after the film flow of molten metal exhaled from the slit-like opening has reached the inside wall of the other longitudinal dam, the direction of flow may be likely changed downward.

SPECIFIC DESCRIPTION OF THE INVENTION

The invention will now be described in detail with reference to the attached drawings.

Figure 1:
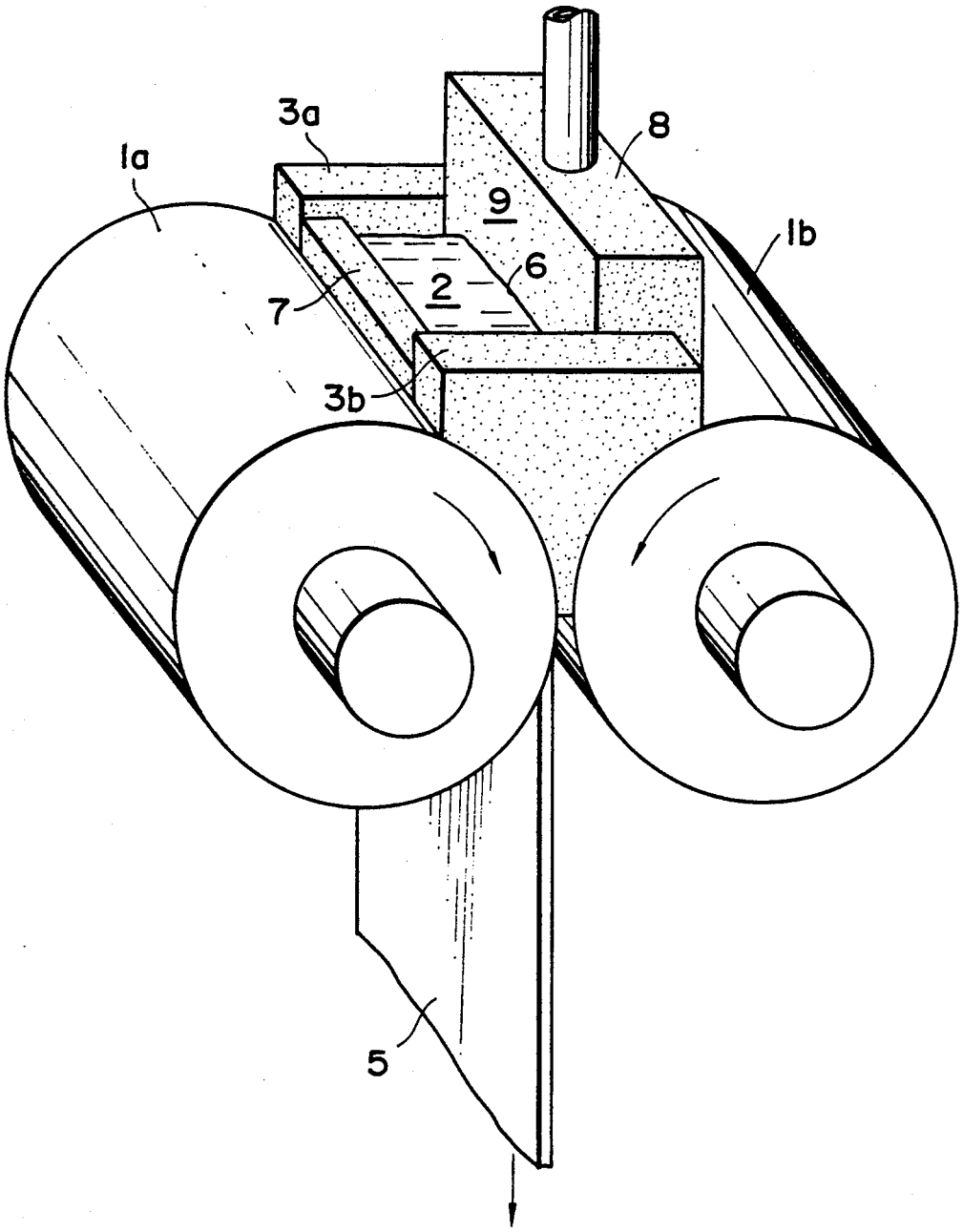
FIG. 1 is a perspective view showing principal parts of an embodiment of the twin roll continuous casting apparatus according to the invention.

FIG. 1 depicts an embodiment of the twin roll continuous casting apparatus comprising a pair of internally cooled rolls 1*a*, 1*b* rotating in the opposite direction to each other disposed in parallel to each other with their axes held horizontal and a pair of side dams 3*a*, 3*b* vertically disposed so that a pool 2 of molten metal having a predetermined height may be formed of the circumferential surfaces of the pair of rolls 1*a*, lb. The molten metal fed in the pool 2 is cooled by the circumferential surfaces of the rolls 1*a*, 1*b* to form solidified shells 4*a*, 4*b* (see FIG. 2) on the surfaces of the respective rolls 1*a*, lb. As the rolls 1*a*, 1*b* rotate, the solidified shells 4*a*, 4*b*, formed on the respective rolls pass through the gap of the rolls where they are combined together and rolled to provide a metal strip 5.

Figure 2:
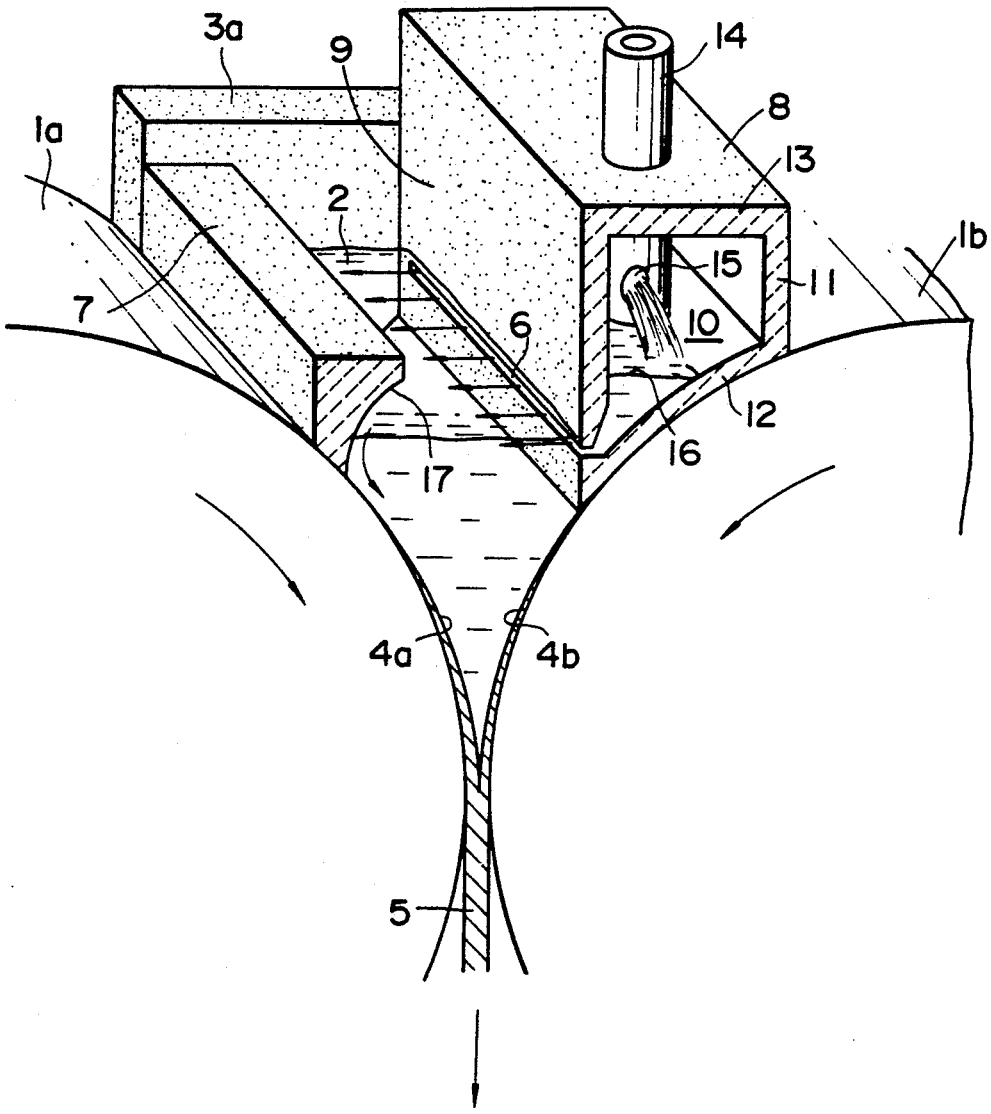
FIG. 2 is a partly cut-away view of the principal parts of the twin roll casting apparatus of FIG. 1.

In such a twin roll continuous casting apparatus it has been a generally prevailing practice in the prior art to pour molten metal in the pool 2 vertically from a means provided above the pool 2. In contrast thereto, the process according to the invention is characterized in that molten metal is poured in the pool 2 in the form of a substantially horizontal film flow directing from one roll to the other in the vicinity of the level of the surface of molten metal in the pool 2. For this purpose, in the twin roll continuous casting apparatus according to the invention, there are disposed, in addition to the pair of side dams 3*a*, 3*b*, a pair of longitudinal dams 7 and 8 having respective inside walls along the direction of the roll axes for forming the pool 2 together with the side dams and the circumferential surfaces of the rolls in such a manner that the bottom surfaces of the longitudinal dams slidably contact the circumferential rolls. One of the longitudinal dams (dam 8 in the illustrated example) is constructed so that it constitutes an intermediate tundish for feeding molten metal to the pool 2 in the form of a substantially horizontal film flow approximately at the level of the surface of molten metal in the pool 2. More specifically, the longitudinal dam 8 is provided with an inner hollow space within the body of the dam 8 and with a slit-like opening 6 horizontally extending in the direction of the roll axes and communicating with the inner hollow space on its inside wall 9 forming the pool of molten metal FIG. 2 is a partly cut-away view of the longitudinal dam 8. As shown in FIG. 2 the longitudinal dam 8 has a volume larger than that of the other longitudinal dam 7 and there is formed within the body of the dam 8 an inner hollow space 10 to which molten metal is supplied and which is defined by an inside wall 9, an outside wall 11, side walls (not seen) contiguous to side dams 3*a*, 3*b*, a bottom wall 12 and a ceiling wall 13. A nozzle 13 for pouring molten metal in the inner space 10 is vertically disposed so that it penetrates through the ceiling wall 13. The upper end of the pouring nozzle 14 is connected to a tundish (not shown) provided above the present apparatus, and the lower end of the pouring nozzle 14 opens to the inner space 10. In the illustrated example, two openings 15 are provided on side wall of the pouring nozzles 14 near the lower end thereof so that molten metal may be exhaled through the respective openings 15 in the direction along the roll axes toward the respective side dams 3*a*, 3*b*. The longitudinal dam 8 is provided with the above-mentioned slit-like opening 6 horizontally extending in the direction of the roll axes and communicating with the inner hollow space 10 on its inside wall 9 at a level lower than the height of the side dams 3*a*, 3*b*. In the illustrated example, the slit-like opening 6 communicates with the inner space 10 at the lowest portion of the inner space 10. While the bottom surface of the longitudinal dam 8 (that is the outer surface of the bottom wall 12) has a curved surface which slidably contacts the circumferential surface of the roll 1*b*, the inner surface of the bottom wall 12 is also formed to a similar curved surface whereby the bottom of the inner space 10 is formed so that it gradually inclines downward toward the inside wall 9 and at the lowest portion of this inclination forming the horizontally extending slit-like opening 6. Thus, when molten metal is poured in the inner space 10 constituting the intermediate tundish and an intermediate pool 16 of molten metal is formed therein, owing to the static pressure of molten metal in the intermediate pool 16, a film flow of molten metal with a flow rate substantially uniform in the transverse direction of the slit-like opening 6 is exhaled through the opening 6 toward the other longitudinal dam 7.

The inside wall 17 of the other longitudinal dam 7 forming the pool of molten metal has a curved surface outwardly expanding downward. Thus, when the film flow of the molten metal exhaled from the slit-like opening 6 has struck the curved inside wall 17 of the longitudinal dam 7, the direction of flow is likely changed downward. The flow which has dived downwards then inverts the direction toward the center of the pool, whereby a flow of molten metal which approaches a circulating flow may be formed.

In that case, if the height of the surface of molten metal in the pool 2 is set near the level of the slit-like opening 6, the film flow of molten metal exhaled from the opening 6 becomes a horizontal flow directed to the longitudinal dam 7 which passes near the level of the surface of molten metal in the pool 2 and after this once the horizontal flow has struck the inside wall 17 of the longitudinal dam 7, it dives downward. Accordingly, the vicinity of the surface of molten metal in the pool 2 is always renewed by a fresh film flow of molten metal successively exhaled from the opening 6. In that case, if the length of the slit-like opening 6 is designed as long as possible, the horizontal film flow of molten metal can be caused to flow unidirectionally over substantially the whole areas of the surface of molten metal in the pool 2 while continuously renewing the surface of molten metal in the pool 2. As a result, no areas where molten metal is stagnant are formed over the whole surface of molten metal in the pool 2, thereby preventing formation of a solidified skin on the surface of molten metal in the pool. Since the horizontal film flow of molten metal which is formed and passes near the level of the surface of molten metal in the pool does not adversely affect solidified shells 4*a*, 4*b* which are formed on the rotating cooling rolls 1*a*, 1*b* below the level of the surface of molten metal, the sound growth of solidified shells is not prevented. Furthermore, according to the invention, since a uniform temperature distribution is ensured in the pool 2, a uniform and stable formation and growth of solidified shells 4*a*, 4*b* can be promoted.

Incidentally, in a case wherein mold powder is used on the surface of molten metal in the pool 2, the slit-like opening 6 should preferably be positioned at a level slightly below the layer of mold powder. By doing so, mold powder may be caused to float in the form of a layer over substantially the whole area of the surface of molten metal in the pool, although a certain quantity of mold powder might float toward the longitudinal dam 7, In any event, the process and apparatus according to the invention do not suffer from a problem of knocking-in of mold powder below the surface of molten metal and quality deterioration resulting therefrom as is the case with the prior art wherein molten metal is poured in the pool in the form of a vertical flow. Furthermore, shut-off of gas and heat through the surface of molten metal in the pool can be effectively made according to the invention.

Figure 3A:
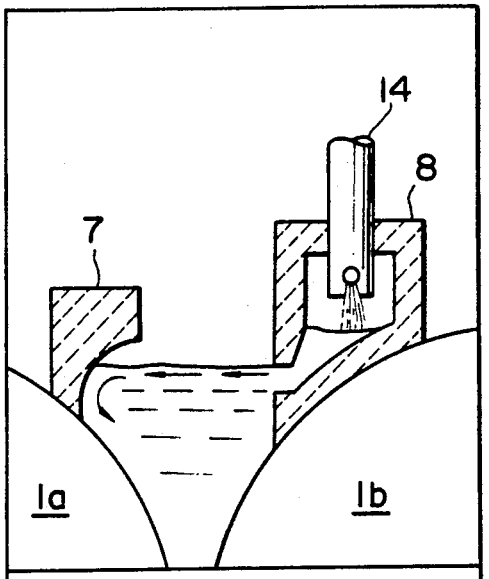
FIG. 3(*a*)–3(*c*) illustrate the effect of the height of the slit-like opening relative to the height of the surface of molten metal in the pool on the flow pattern of the film flow of molten metal.
Figure 3B:
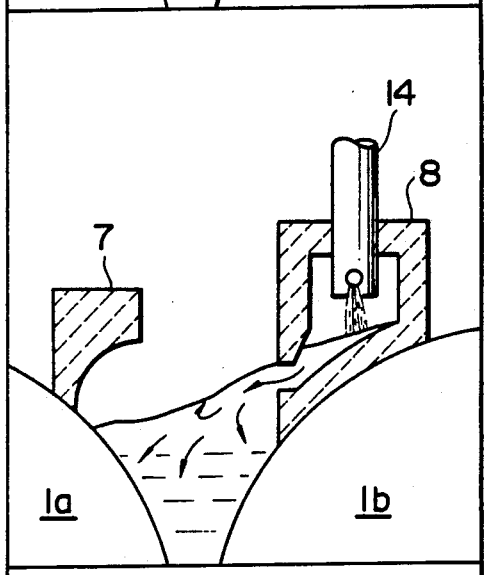
Figure 3C:
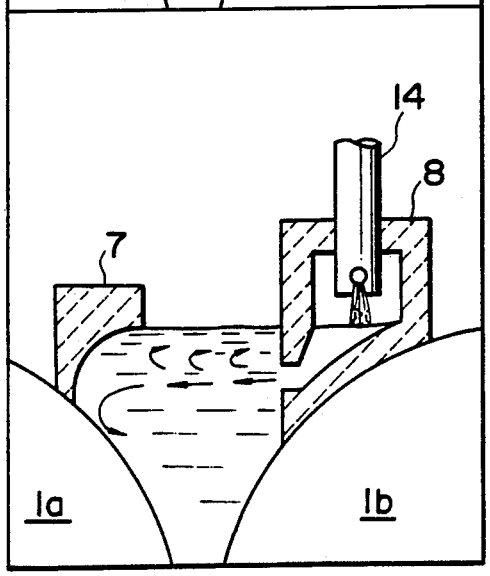

FIG. 3 illustrates the effect of the height of the slit-like opening 6 relative to the height of the surface of molten metal in the pool 2 on the flow pattern of the film flow of molten metal. In a case wherein the height of the surface of molten metal in the pool 2 is approximately equal to the height the slit-like opening 6, as shown in FIG. 3 (*a*), the film flow of molten metal exhaled from the opening 6 passes the vicinity of the level of the surface of molten metal in the pool 2 until it reaches the inside wall 17 of the longitudinal dam 7, and thereafter dives downward along the curved surface of the inside wall 17. Accordingly, no areas where molten metal is stagnant are formed in the vicinity of the surface of molten metal in the pool 2. In a case wherein the height of the surface of molten metal in the pool 2 is substantially lower than the height the slit-like opening 6, as shown in FIG. 3 (*b*), the greater the difference between these heights, the molten metal flow approaches the more declined falling flow. As a result, the surface of molten metal in the pool and the vicinities thereof are influenced so that no steady flow of molten metal is formed and solidified shells formed and grown on the circumferential surfaces of the rolls are adversely affected. In a case wherein the height of the surface of molten metal in the pool 2 is substantially higher than the height the slit-like opening 6, as shown in FIG. 3 (*c*), the greater the difference between these heights, the more likely a reverse flow something like eddy current is formed in the upper part of the film flow of molten metal, rendering the flow rate in that part slower to form stagnant areas leading to the undesired solidified skin on the surface of molten metal in the pool. It has been experimentally confirmed, however, that if the height of the surface of molten metal in the pool 2 is higher than the height the slit-like opening 6 by less than 5 times the thickness of the opening, the above-mentioned reverse flow and, in in turn stagnant areas near the level of the surface of molten metal, are hardly formed. It has also been found that the thickness of the slit-like opening, that is the distance between upper and lower edges of the opening 6 is preferably not more than the thickness of the strip 5 to be cast. Further, from the view point of complete prevention of stagnant areas near the level of the surface of molten metal and uniform temperature distribution of molten metal in the pool, the smallest possible distance between the slit-like opening 6 and the inside surface 17 of the longitudinal dam 7 is advantageous.

Using the illustrated apparatus, a strip of SUS 304 having width of 1,000 mm and a thickness of 2 mm was prepared. The size of the slit-like opening was 2 mm×960 mm, and the height of the surface of molten steel in the pool was controlled so that it may be maintained above the slit-like opening by 5 mm. During the casting operation, the formation of any solidified skin was observed in the vicinity of the level of the surface of molten steel, and the temperature distribution of molten steel in the pool was uniform. As a result, a uniform and stable solidification proceeded, providing a product free from surface defects such as crackings.

EFFECT OF THE INVENTION

In the process according to the invention, over the whole areas of the surface of molten metal in the pool, molten metal near the level of the surface flows and moves, thereby preventing the occurrence of stagnant areas on the surface of molten metal and the formation of a solidified skin due to it and providing a uniform temperature distribution of molten metal in the pool to ensure uniform and stable formation of solidified shells. Therefore, the invention is productive of advantageous results as summarized below.

(1). By the process according to the invention, surface defects of the cast strip due to the solidified skin, crackings, porosity, molten metal wrinkles and other surface defects of the strip due to non-uniform solidification of shells as well as variations in the thickness of the strip due to variations in the thickness of solidified shell are effectively prevented, whereby quality of the product can be enhanced.

(2). Since the apparatus according to the invention is characterized by constructing one of the longitudinal dams so that it constitutes an intermediate tundish, the apparatus is not expensive and can be easily run. Furthermore, it can be effectively run without the need of electromagnetic or sonic stirring of molten metal in the pool.

(3). Since the contact area of the intermediate tundish with molten metal is small and no separate nozzles directly immersed in molten metal are used herein, extraction of heat from molten metal is small, and therefore, running stability at the early stage and enhancement of quality of the product can be achieved.

(4) Products produced by a prior art process involving the step of pouring high temperature molten metal in the pool have frequently exhibited surface defects of high temperature crackings. In the process according to the invention flowing effect of molten metal near the level of the surface of molten metal in the pool is so remarkable that a solidified skin is hardly formed on the surface of molten metal even if molten metal of a relatively low temperature is poured in the pool. As a result the invention has made it possible to run the process at a relatively low temperature, eliminating the above-mentioned defects of high temperature crackings.

(5). Above the surface of molten metal in a pool formed in the intermediate tundish is an open space having no obstacles such as nozzles disposed and flowing and stirring effect of molten metal is extremely remarkable near the level of this surface of molten metal in the intermediate tundish. Thus, from the open space desired alloying elements such as Al, Ti and Nb may be conveniently added to the molten metal.

(6). Since above the surface of molten metal in the pool formed on the circumferential rolls is open, if mold powder is used it can be uniformly sprayed on the surface of molten metal. According to the invention, not only a problem of knocking-in of mold powder below the surface of molten metal and quality deterioration resulting therefrom is obviated, but also, shut-off of gas and heat through the surface of molten metal in the pool can be effectively made.

(7). Since above the surface of molten metal in the pool is open and no solidified skin is formed on the surface of molten metal, the state of flow on the surface of metal can be easily observed either visually or by a sensor for detecting the height (level) of the surface of molten metal disposed so that it may come in and out the space above the surface of molten metal for a purpose of precisely controlling the level of the surface of molten metal in the pool.

(8). Since above the surface of molten metal in the pool formed in the intermediate tundish is merely an open space, it may be easily sealed by a suitable cover, and the atmosphere of the so sealed space may be easily controlled with an inert gas such as Ar.

What is claimed is:

1. A process for continuously casting a metal strip by means of a twin roll continuous casting apparatus comprising a pair of internally cooled rolls rotating in the opposite direction of each other and disposed parallel to each other with their axes held horizontally and a pair of side dams for forming a pool of molten metal having a predetermined height on the circumferential surfaces of the pair of rolls, said pair of side dams disposed in the direction perpendicular to the roll axes with a space therebetween approximately corresponding to the width of a metal strip to be cast, said process comprising the steps of continuously pouring molten metal in said pool of molten metal so that the predetermined level of the molten metal may be maintained in the pool, and continuously casting the molten metal in the pool through a gap between the pair of rolls to form a metal strip while cooling the molten metal with the circumferential surfaces of the pair of rolls, said continuous pouring of molten metal further comprising substantially horizontally and unidirectionally flowing said molten metal from one roll towards the other roll and into said pool at a level below the surface of said pool to form a substantially horizontal and unidirectional film flow of molten metal.

2. The process for continuously casting a metal strip in accordance with claim 1 wherein after the film flow of the molten metal has reached the other roll, the molten metal film flow is directed downwardly.

3. A twin roll continuous casting apparatus comprising:

i) a pair of internally cooled rolls rotating in the opposite direction of each other and disposed parallel to each other with their axes held horizontal;

ii) a pair of side dams for forming a pool of molten metal having a predetermined height on the circumferential surfaces of the pair of rolls, said pair of side dams disposed in the direction perpendicular to the roll axes with a space therebetween approximately corresponding to the width of a metal strip to be cast; and iii) a pair of longitudinal dams having respective inside walls along the roll axes to form the pool of molten metal together with the pair of side dams and having respective bottom surfaces, the circumferential surfaces of the pair of rolls being disposed in such a manner that the bottom surfaces of the longitudinal dams slidably contact the circumferential surfaces of the pair of rolls;

iv) one of the longitudinal dams having an inner hollow space within the body of said longitudinal dam and a slit-like opening on the inside wall thereof, said slit like opening horizontally extending in the direction of the roll axes and communicating with said inner hollow space whereby said longitudinal dam having the inner hollow space and the slit-like opening forms an intermediate tundish for pouring molten metal into said pool;

v) whereby continuously cast metal strip is formed by continuously pouring molten metal from the intermediate tundish into said pool and through said gap while cooling the molten metal with the circumferential surfaces of the pair of rolls.

4. The twin roll continuous casting apparatus in accordance with claim 3 wherein the inside wall of the other longitudinal dam forming the pool of molten metal has a curved surface configured to direct said molten metal in the pool downwardly.

* * * * *